US006279901B1

(12) United States Patent
Fulmer

(10) Patent No.: US 6,279,901 B1
(45) Date of Patent: Aug. 28, 2001

(54) IDENTIFICATION CARD INVERTER THAT MAINTAINS THE CARD SUPPORT PLANE

(75) Inventor: Gary B. Fulmer, Eden Prairie, MN (US)

(73) Assignee: Fargo Electronics, Inc., Eden Prairie, MN (US)

( * ) Notice: Subject to any disclaimer, the term of this patent is extended or adjusted under 35 U.S.C. 154(b) by 0 days.

(21) Appl. No.: 09/430,601

(22) Filed: Oct. 29, 1999

(51) Int. Cl.[7] ..... B65H 29/00
(52) U.S. Cl. ..... 271/272; 271/186
(58) Field of Search ..... 271/186, 187, 271/272; 347/218; 400/188

(56) References Cited

U.S. PATENT DOCUMENTS

| | | | | |
|---|---|---|---|---|
| 3,917,256 | * | 11/1975 | Kubasta | 271/186 |
| 5,326,092 | * | 7/1994 | Ando | 271/272 |
| 5,332,889 | | 7/1994 | Lundstrom et al. | 235/380 |
| 5,381,209 | | 1/1995 | Binder et al. | 355/27 |
| 5,709,484 | | 1/1998 | Dorner | 400/188 |
| 5,771,058 | | 6/1998 | Kobayashi | 347/218 |
| 5,927,713 | | 7/1999 | Driscoll et al. | 271/298 |
| 5,941,522 | | 8/1999 | Hagstrom et al. | 271/225 |
| 5,959,278 | * | 9/1999 | Kobayashi et al. | 347/218 |

FOREIGN PATENT DOCUMENTS

| | | |
|---|---|---|
| 62 631 | 6/1892 | (DE) . |
| 431 172 | 6/1991 | (EP) . |
| 5-159531 | 6/1993 | (JP) . |

* cited by examiner

*Primary Examiner*—H. Grant Skaggs
(74) *Attorney, Agent, or Firm*—Westman, Champlin & Kelly, P.A.

(57) ABSTRACT

A card inverter or "flipper" is used in connection with card printers and laminators for inverting cards which are to be printed and/or laminated on two sides, so that after operations on one side have been completed, the card can be inverted and fed back to the processing stations for processing the second side of the card. This can be done with cards that are being programmed, for example, "Smart Cards" that will be moved to different stations for processing, and also can be used in connection with lamination stations where the card will be printed on two sides, and then a laminate film layer placed over both sides of the card The card inverter or flipper is supported about a central axis that bisects the plane of the card, and the inversion is about this axis so that the card plane is maintained in the first position of the card as well as the inverted position of the card.

10 Claims, 4 Drawing Sheets

IDENTIFICATION CARD INVERTER THAT MAINTAINS THE CARD SUPPORT PLANE

CROSS REFERENCE TO RELATED APPLICATION

Reference is hereby made to U.S. patent application Ser. No. 09/430,566, for WASTELESS LAMINATOR filed on even date herewith and both fully incorporated by reference.

BACKGROUND OF THE INVENTION

The present invention relates to an identification inverter which will receive a card, and rotate the card about an axis lying transversely to the card and coincident with the bisecting plane of the card so that when rotated to any angular position including inversion, the plane of the card stays on the axis of rotation.

Various card "flippers" or inverters have been advanced in the art, where the plane of the card is offset from its original plane when it is inverted 180°. U.S. Pat. No. 5,771,058 discloses a device that will turn a card about an axis on the central plane of the card, but it requires at least two sets of rollers and a belt drive for the rollers.

It has been found that it is desirable in many instances to print information on both sides of an identification (ID) card, and also to provide a protective laminate over printed material, photographs, holographs and the like on both sides of the ID card. In order to print and laminate both sides efficiently, the card is inverted and then moved in reverse, back through the printer head or laminating section and then forwardly so that a separate operation is performed, such as printing or adding a laminate layer on the second side of the card. When the card inverter or flipper offsets the plane of the card, special accommodations for handling the card for the operation on the second side have to be made. With the present invention, the card plane does not shift after a full 180° inversion, so that the card can easily be fed back through a printer or laminating section for processing the second side.

SUMMARY OF THE INVENTION

The present invention relates to a card or substrate inverter that has a plate assembly comprising a pair of guides that receive an identification card, and a drive that will grip a card and drive it along the guide and serve to hold or clamp the card when desired. The drive and clamp comprises a pair of rollers. One of the rollers is driven through a gear set supported on an input shaft that has an axis on the bisecting plane of the card. The input shaft supports the card guides and drive roller on one side of the guides. A separate guide assembly support and invertive drive is provided on the opposite side of the card guides. The separate drive is used for inverting the guides, including the card drive, about an axis that lies on the center plane of the card. The guides can be rotated 180° or a full 360°, as needed or desired. The rotation can be to any other angular position as well, if the card is diverted from its plane of travel for processing, such as associating with encoding circuitry for smart cards, magnetic encoders for encoding cards, magnetic stripes on cards, or cards that are encoded with non contact (RF) circuits.

The inverter drive is simple to operate and uses standard drive motors. The card drive rollers are rotationally driven from one side of the inverter, while the guides, which as shown comprise a pair of plates forming a plate assembly, are driven from the opposite side of the card inverter of effecting the card rotation.

The use of a pair of drive rollers, as shown, permits very precise control of the positioning of the card, and is lower cost compared to using belt drives to separate sets of rollers. The rollers of the present invention act as a clamp for holding the card as well as acting to drive or feed the card when desired.

DETAILED DESCRIPTION OF THE ILLUSTRATIVE EMBODIMENTS

Figure 1:
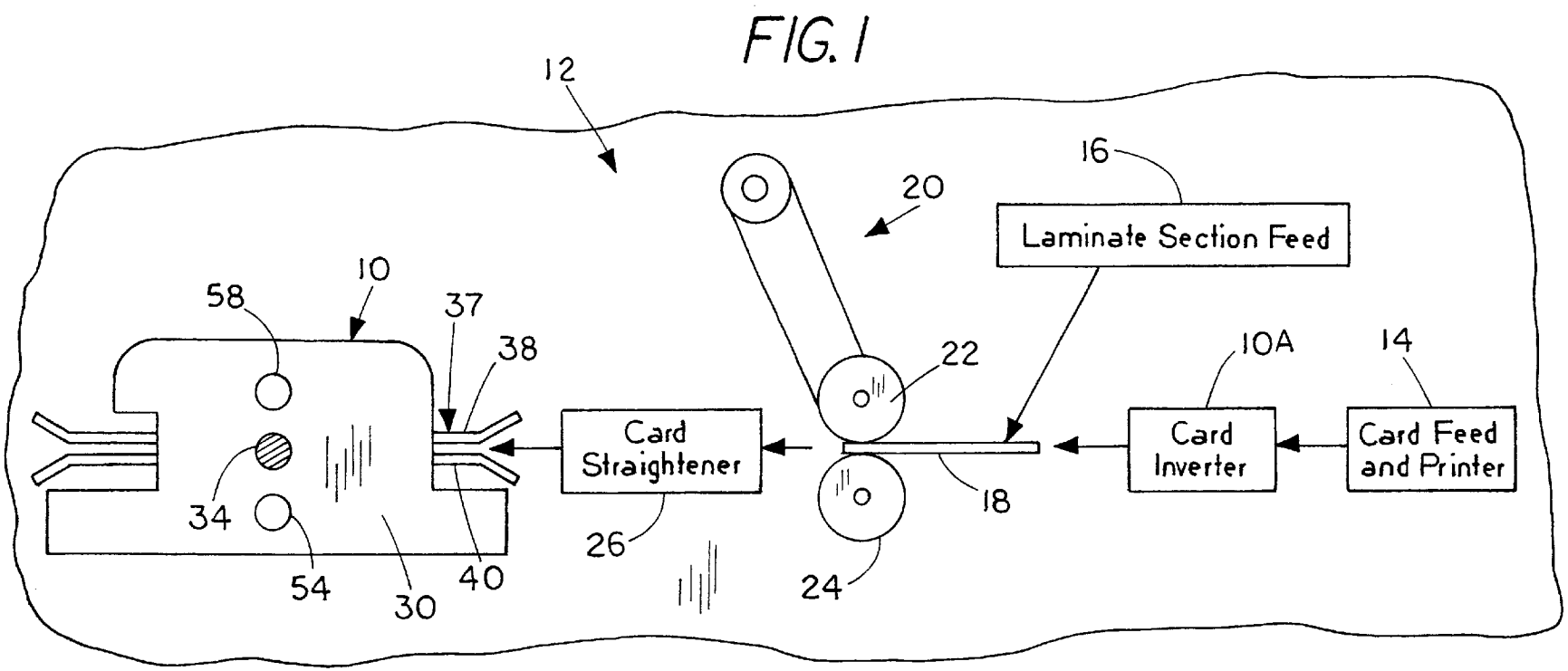
FIG. 1 is a schematic representation of a typical laminator assembly used for laminating cards, and having a card inverter made according to the present invention installed thereon.
Figure 2:
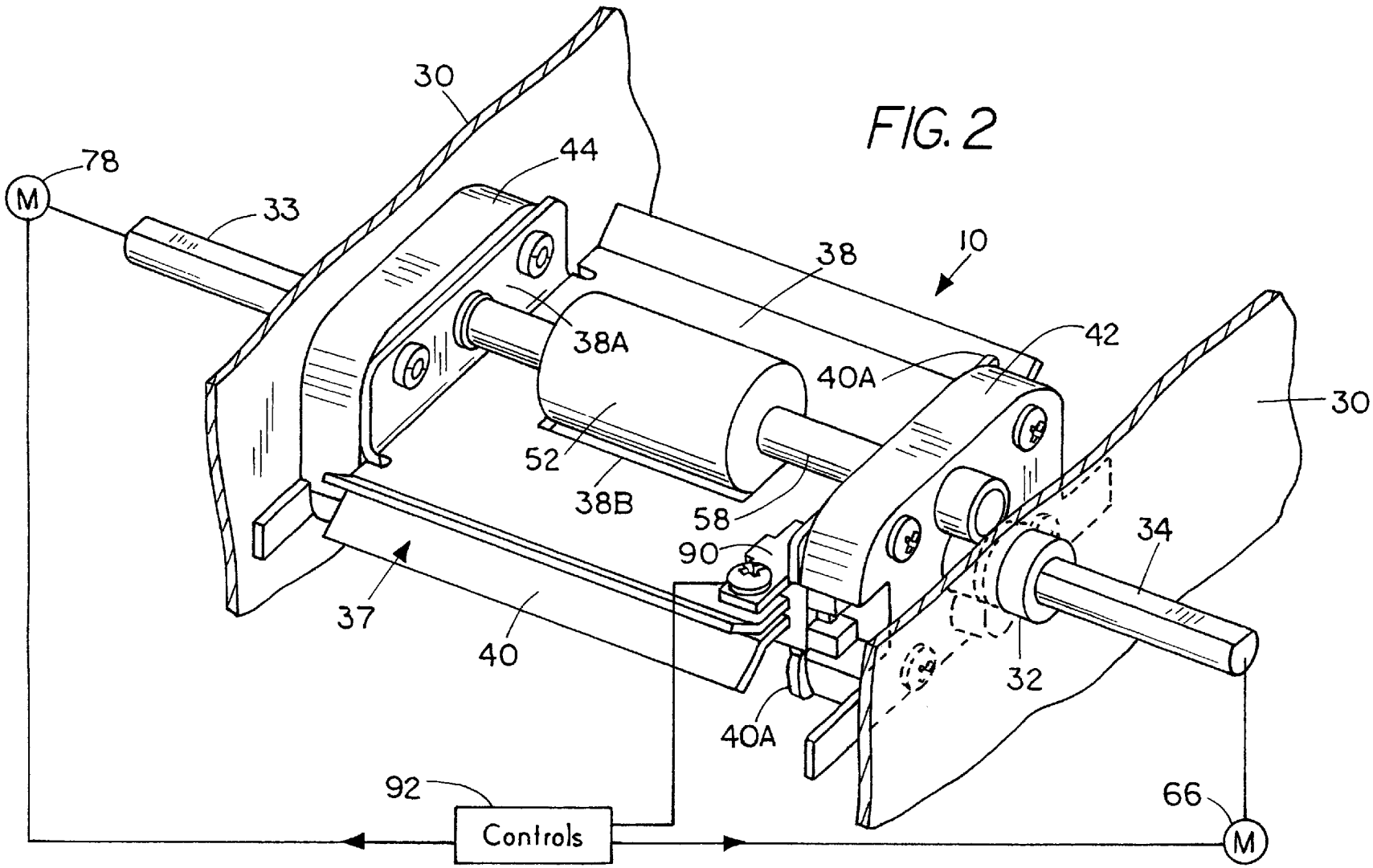
FIG. 2 is an enlarged perspective view of the card inverter of FIG. 1.
Figure 3:
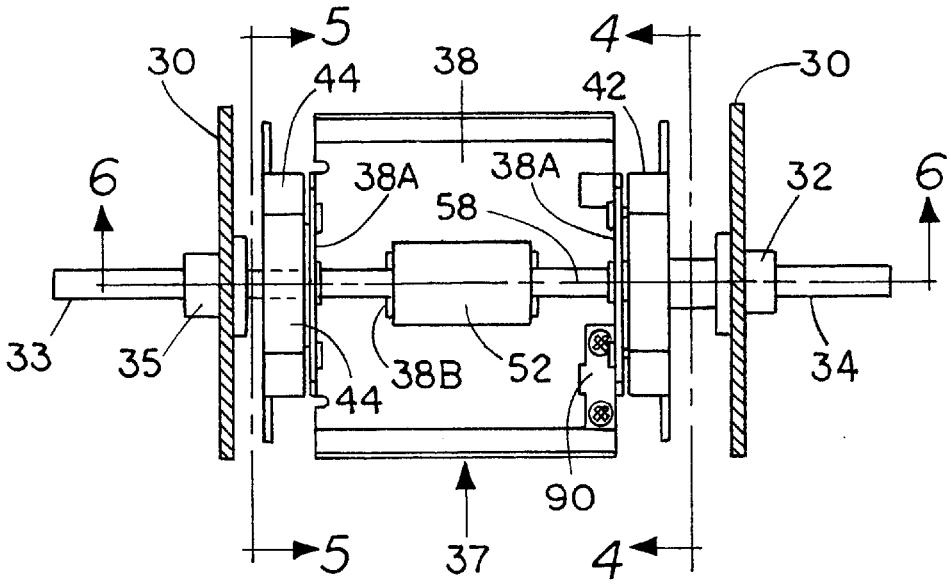
FIG. 3 is a top plan view of the card inverter made according to the present invention.

Referring to FIG. 1, the card inverter 10 of the present invention is illustrated in detail in connection with a lamination of a printer and card laminating assembly 12. The printer and card laminating assemblies are typically used in a card printer, but any printer which either prints or laminates on both sides of a card would use the card inverter of the present invention.

A card feed and printer 14 are shown schematically. After printing one side of a card, the card is provided to a first card inverter 10A, which is the same construction as inverter 10, and which will invert the card and move it back to the printer for printing a second side, if desired. A laminate section feed 16 will feed individual sections of a laminate material for mounting and laminating onto an identification card 18 for example, in a laminating section 20. The laminating section or lamination station 20 includes a heat source for causing a layer of laminating material to adhere to the card surface. As shown lamination is carried out with a heated laminating roller 22 and a pinch or support roller 24 through which the card and the laminate material sections pass. If two sides of the card are printed, a laminate material may be placed on both sides of the card, but lamination will be carried out one side at a time. The lamination station 20 can be any desired construction and is not limited to a roller.

A card straightener 26 can be provided for receiving the card and straightening any curl that may have occurred in the card because of the application of heat from the laminating roller 22. Then the card 18 is fed into the inverter 10, which is used for inverting the card 18 so the unlaminated side faces up. The inverted card is fed back through the card straightener 26 and the laminating section 20 to position the card 18 to receive another laminate section from the laminate section feed 16. The second side of the card 18 can thus be laminated.

Two sided printing is preferably carried out by printing one side, flipping or inverting the card in inverter 10A, feeding the card back to the printer, and printing the second side, after which the laminating of both sides takes place.

Figure 6:
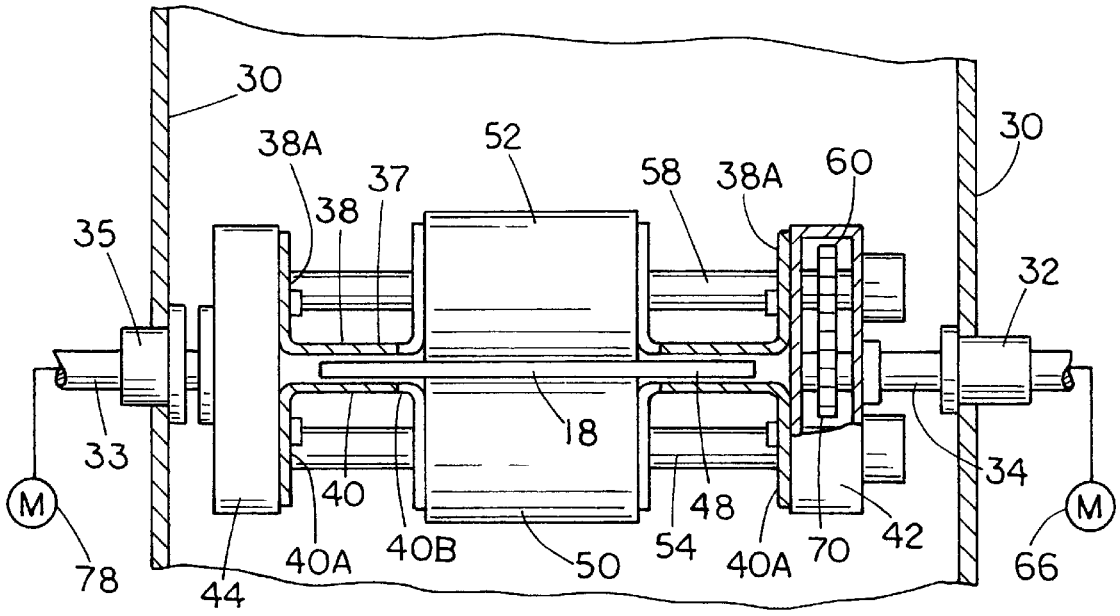
FIG. 6 is a sectional view taken along line 6—6 in FIG. 3.

The card inverter 10 (and 10A) includes, as is shown in FIGS. 2 through 6, suitable side frame walls 30, 30 that are spaced apart, and are used to provide support for bearings or bushings 32 and 35 (FIG. 3) that rotatably mount stub shafts 33 and 34. The card inverter includes a card support 37 made up of a pair of card guides comprising plates 38 and 40, as shown. The guide plates 38 and 40 are planar members that have planes that are perpendicular to walls 30. The guide plates 38 and 40 of the card support 37 have flanges on their side edges, with the top guide plate 38 having bent up flanges 38A on its opposite sides, and the bottom guide plate 40 having bent down flanges 40A (FIG. 6). Flanges 38A and 40A are attached on one side to a gear housing 42. The flanges 38A and 40A are attached to a drive housing 44, which is a bearing and shaft support on an opposite side. The flanges 38A and 40A are attached to the respective housing 42 and 44 with suitable screws, as can be seen so the card support 37 is held by the housings.

The card guide plates 38 and 40 are held coplanar and spaced apart a desired amount. The guide plates 38 and 40 have central openings that are shown at 38B in FIG. 2, and 40B in FIG. 6. The openings 38B and 40B permit a drive roller 52 and a pinch roller 50 to pass through the respective planes of the guide plates into the space indicated at 48 (FIG. 6) between the guide plates 38 and 40. A lower roller is the idler pinch or backing roller 50, and serves to pinch the card against the upper drive roller 52. The upper drive roller 52 is driven to drive the card 18 shown in both FIGS. 5 and 6, for example. The lower roller 50 is mounted onto a shaft 54 that is rotatably mounted in suitable bearings in the wall of the gear housing 42, and is rotatably mounted on the drive housing 44 so that the roller 50 is rotatably mounted about the axis of the shaft 54. A portion of the periphery of the lower roller 50 protrudes through the opening 40B into the space 48.

Figure 4:
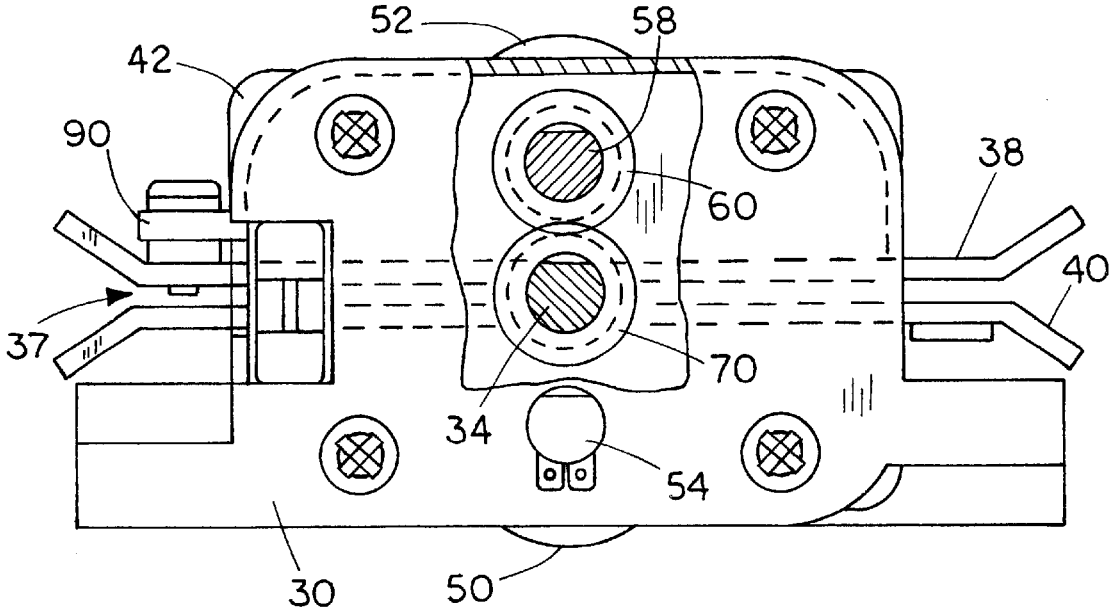
FIG. 4 is a side view taken generally along line 4—4 in FIG. 3, with parts in section and parts broken away.
Figure 5:
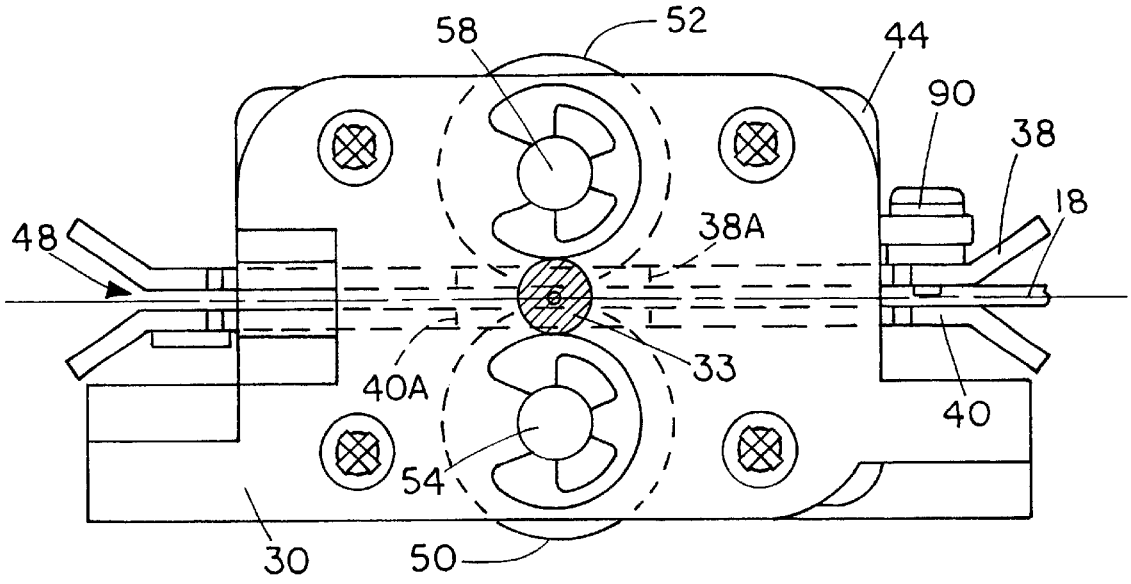
FIG. 5 is a sectional view taken along line 5—5 in FIG. 3.

The drive roller 52 is mounted onto a shaft 58 that extends through and drivably mounts the roller. The shaft 58 is supported on and extends into the gear housing 42. A spur gear 60 is drivably mounted on the shaft 58 within the gear housing 42, as shown in FIGS. 4 and 6. The gear box 42 is broken away in FIG. 4 and the gear 60 is shown. The opposite end of the shaft 58 is mounted in a suitable bearing (not shown) in the drive housing 44.

The spacing of the rollers 50 and 52 can be selected so that the rollers, which have elastomeric surfaces, will engage and drive a card 18. When the roller 52 is stopped from rotating, the rollers hold or clamp the card in position for inversion or flipping. The gear 60 for drive shaft 58 is driven with a gear 70 on stub shaft 34. The stub shaft 34 is mounted in the bearing or bushing 32 in one of the side walls 30, and the opposite end of the stub shaft 34 is rotatably mounted in suitable bearings in the gear housing 42, so that the stub shaft provides a support for the gear housing. The spur gear 70 is drivably mounted on the shaft 34 within the gear housing 42, and serves to drive the gear 60 so that when a reversible, variable speed D.C. motor 66 used for driving shaft 34 is running, the shaft 58 is turned through the gears 70 and 60.

The opposite side of the card inverter 10 adjacent drive housing 44 is supported on stub shaft 33 that is mounted in the bushing 35 in the opposite wall 30 of the frame. Shaft 33 is drivably attached to the drive housing 44. The stub shafts 33 and 34 are co-axial, and the axes of the shafts 33 and 34 lie on the central plane of a card 18 held in the rollers 50 and 52. The axis of rotation of the shafts 34 and 33 thus lies along the bisecting plane of the card 18, and the axes of these shafts are parallel to the card plane. A stepper motor 78 is used for driving the shaft 33 in a suitable manner, and this motor will rotate the shaft 33 in the bushing 35, and drive the drive housing 44 about the axis of the shaft 34. Since the flanges 38A and 40A of support plate 38 and 40 on that side of the card inverter are attached to the drive housing 44, the entire inverter plate assembly or card support will rotate about the axis of the shaft 34, without driving the roller 52. Since shaft 33 and shaft 34 are coaxial, the gear 60 will merely rotate around the gear 70 without rotating the roller 52. The stepper motor 78 is controllable with controls 92 to stop rotation of the inverter plate assembly or card support at any desired angular indexed position.

Thus, when drive housing 44 is rotated, a card 18 in the rollers 50 and 52 will be clamped and will not be moved along its plane, but will be flipped 180° from the position shown in the Figures, to an inverted position, upon rotation of the shaft 74. The rollers 50 and 52 act as a clamp for the card as it is inverted.

The motor 78 can be stopped and it will lock the housing 44 in its stopped position. While flipping 180° is shown, the card can be stopped in any desired angular position. Then when the motor 66 is again driven, the roller 52 will be driven by the gears 70 and 60 to engage a card 18 and drive a card in the rollers along the support plates 38 and 40.

The single set of rollers 50 and 52 (one drive and one pinch roller) are clamps to clamp and hold the identification card 18 securely during the rotation. The roller 50 forms a backing member for the roller 52 which clamps the card 18 and which will drive the card when powered. The motor 66 is rotated in reverse to drive the card 18 back into the laminating section 20 through the card straightener, if one is used. The card 18 is received at suitable drive rollers for the card feed coming from the printer, and then re-fed into the laminating roller 22 of the laminate section 20 on the second side of the card, which will then be laminated to the card. The card inverter 10 will then receive the card, and rollers 50 and 52 will drive it through the inverter. The finished card can be placed into a storage hopper or other receptacle. The inverter 10A will invert the card for printing a second side and then move the card for an additional operation, as shown, laminating the card.

A card sensor 90 is mounted on plate 38 and used to sense a presence or absence of a card 18 between plates 38 and 40. The sensor signal is provided to a central controller 92 that will energize the appropriate motor to move the card, or invert or index the card through motor 78, according to the program that is provided to the controls. The controls also will cause movement of the card through the printer and first inverter 10A.

The inverter thus is simple in construction, with few complex moving parts, and permits rotating the card 18 about an axis that bisects the card so that the card comes back to its same plane when it is in its rotated position as when it started. This permits the card to be fed directly back into the card straightener, because the card is not offset from the original position. Only one set of rollers is needed for moving the card through the inverter as well as clamping the card while inverting the card.

Although the present invention has been described with reference to preferred embodiments, workers skilled in the art will recognize that changes may be made in form and detail without departing from the spirit and scope of the invention.

What is claimed is:

1. A card handling mechanism for inverting a card about a central axis of the a plane of the card comprising a card support, a pair of mounting shafts, one on each side of said card support, said shafts having coincidental axes and lying along a central plane of a card support, first and second rollers rotatably mounted on the card support on opposite sides of the plane of the card support, the rollers clamping a card therebetween and driving a card when one roller is rotated about an axis, a first gear mounted on a first shaft of said pair of shafts, a second gear mounted on an end of one roller and engaging the first gear, a drive effective to drive the card support from a second of the pair of shafts to selectively rotate the card support about the axes of the shafts, the first and second gears being the same size so that the card support can rotate about the shaft axes without driving the one roller.

2. The card handling mechanism of claim 1, wherein said card support comprises a pair of card support plates, a card positioned between said card support plates, each of the rollers extending through openings in a separate plate to engage a card between the card support plates.

3. The card handling mechanism of claim 1 and a stepper motor, forming a part of the drive to rotate the card support, the stepper motor being controllable to stop rotation of the card support at a selected indexed position.

4. A card handling mechanism for turning an identification card about a central axis lying in a plane of the card, said card handling mechanism including a pair of spaced apart support walls, an assembly of a pair of card guides supported on first and second housings on opposite sides of the card guides, and each of the housings being supported by a separate mounting shaft extending through bearings on the respective spaced support walls, a single pair of drive rollers mounted in mid portions of said card guides, one on one side of a first card guide and the other on the other side of a second card guide, a drive gear on a first of said mounting shafts for driving one of said rollers, the rollers having shaft portions extending into and rotatably mounted on the housing supported by a second of said mounting shafts.

5. The card handling mechanism of claim 4 and a card sensor on one of said card guides for sensing the presence or absence of a card between the card guides.

6. The card handling mechanism of claim 4, wherein said card guides comprise plates having mounting flanges on opposite side edges thereof, the mounting flanges of each plate extending in direction away from the other plate, and said flanges being mounted to a gear housing and a drive housing, respectively, for supporting the two plates forming the card guide in a spaced apart position.

7. The card handling mechanism of claim 4 and separate controllable motors drivably connected to the respective mounting shafts, and a central control for controlling said motors.

8. The card handling mechanism of claim 4 and a controllable motor for driving a second mounting shaft, the housing supported by the second of the mounting shafts, being drivable connected to both of the card guides, said controllable motor being controlled to index the card guides at different angular positions about the axis of said second mounting shaft.

9. A card handling mechanism for inverting a card about a central axis of the plane of the card comprising a card support; a pair of mounting shafts, one on each side of said card support; said mounting shafts having coincidental axes and lying along a central plane of a card support; a clamp to hold a card relative to said card support, wherein said clamp comprises a drive roller and a pinch roller, the pair of mounting shafts including one mounting shaft having a drive gear thereon; a driven gear mounted on a shaft for the drive roller and engaging the drive gear, whereby driving one of said pair of mounting shafts causes the drive roller to be driven; the second of said shafts being drivably mounted to a drive housing; said rollers having roller shafts that are rotatably mounted in said drive housing; the second of said mounting shafts being drivably connected to the drive housing; said card support comprising a pair of card support plates spaced to permit a card to pass between the card support plates, each roller extending through an opening in one plate, respectively, to engage a card between the card support plates, the card support plates being substantially planar, and having flanges bent out of the planes of the respective plates along side edges thereof, the flanges of each plate extending in a direction away from the other plate, and the flanges on one side of both plates being attached to the gear housing, and the flanges on the other side of both plates being attached to the drive housing; and a drive effective to drive the card support from at least one of the pair of mounting shafts to rotate the card support about the axes of the mounting shafts.

10. A card handling mechanism for turning an identification card about a central axis lying in a plane of the card, said card handling mechanism including first and second support members on opposite sides of a card path, each of the support members being supported by a separate mounting shaft, a single pair of drive rollers mounted on and extending between the support members, the drive rollers being positioned to engage and selectively hold and drive a card, a first selectively operated drive to one of the rollers to rotate the rollers about roller axes, and a second selectively operated drive to one of the support members, the second drive rotating the support members, the rollers and a card held between the rollers while the rollers remain holding the card between the rollers and do not rotate about the roller axes.

* * * * *

UNITED STATES PATENT AND TRADEMARK OFFICE

CERTIFICATE OF CORRECTION

PATENT NO. : 6,279,901 B1
DATED : August 28, 2001
INVENTOR(S) : Gary B. Fulmer

It is certified that error appears in the above-identified patent and that said Letters Patent is hereby corrected as shown below:

Column 4,
Line 65, cancel "the" (first occurrence).

Column 6,
Line 2, cancel "drivable" and insert -- drivably --.

Signed and Sealed this

Twenty-sixth Day of March, 2002

*Attest:*

*Attesting Officer*

JAMES E. ROGAN
*Director of the United States Patent and Trademark Office*